US007726988B2

(12) United States Patent
Martin

(10) Patent No.: US 7,726,988 B2
(45) Date of Patent: Jun. 1, 2010

(54) ELECTRICAL CONNECTOR HAVING DISCONNECTION ASSIST

(75) Inventor: Galen M. Martin, Camp Hill, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 12/409,643

(22) Filed: Mar. 24, 2009

(65) Prior Publication Data

US 2009/0246992 A1 Oct. 1, 2009

Related U.S. Application Data

(60) Provisional application No. 61/070,836, filed on Mar. 26, 2008, provisional application No. 61/070,835, filed on Mar. 26, 2008.

(51) Int. Cl.
*H01R 13/62* (2006.01)

(52) U.S. Cl. ..... 439/157

(58) Field of Classification Search ..... 439/157
See application file for complete search history.

(56) References Cited

U.S. PATENT DOCUMENTS 6,558,176 B1 * 5/2003 Martin et al. ..... 439/157
6,854,992 B2 * 2/2005 Martin et al. ..... 439/157

* cited by examiner

*Primary Examiner*—Neil Abrams

(57) ABSTRACT

An electrical connector assembly includes a plug assembly for mating with a header. The plug assembly includes a plug housing and a lever, where the lever includes gear teeth which cooperate with a tooth on the header in a rack and pinion fashion. The lever is locked to the plug housing when the lever is poised for the plug housing to be inserted into the header. A release member on the header releases the lever from the locked position allowing the lever to be rotated to the position where the lever gear teeth mesh with the header tooth, to draw the plug assembly into the header. A cam on the lever also contacts a contact surface in the header, which pre-lifts the plug assembly during disconnection.

18 Claims, 8 Drawing Sheets

ELECTRICAL CONNECTOR HAVING DISCONNECTION ASSIST

RELATED APPLICATION

This application claims priority from Provisional application Ser. No. 61/070,836 filed Mar. 26, 2008, the entirety of which is incorporated herein by reference.

This application is related to Provisional application Ser. No. 61/070,835 filed Mar. 26, 2008, now U.S. patent application Ser. No. 12/409,632 filed Mar. 24, 2009.

SUMMARY

The invention is directed to an electrical connector assembly having a plug assembly and a header assembly, and more particularly, where the plug assembly includes a lever which draws the plug assembly into a header upon rotation of the lever.

Electrical connectors having a lever which is rotated to bring the plug assembly into position within a header find broad use in connector technology, particularly in automotive technology. The levers have gear teeth which mesh with complementary teeth on the header, in a rack and pinion fashion, to draw the plug assembly into electrical connection with the header.

Typically, the levers include two gear teeth which must be properly oriented to ensure that the lever teeth overlap the tooth on the header. Due to the fact that the two teeth must be angularly spaced apart a distance adequate to allow a receiving area between the two teeth, to be received over the header tooth; the lever will have unused rotary travel. Furthermore, due to the initial contact angle between the lever tooth and the header tooth, the initial torque on the lever required to initiate movement may be great and may bind up in the header. These and other improvements have been incorporated and described herein.

In one embodiment, a connector assembly comprises a header having a cavity defined by at least one wall, the wall having a gear tooth positioned on an inner surface thereof. A plug assembly comprises a plug housing and a lever rotatably mounted on the plug housing, where the lever has at least one gear tooth cooperable with the header gear tooth, such that rotation of the lever causes engagement of the header gear tooth and the plug housing gear tooth, drawing the plug member into the cavity. A lifting member lifts the plug assembly out of the header when the lever is counter-rotated.

In another embodiment, a connector assembly comprises a header having a cavity defined by at least one wall and a post positioned within the header, where the wall has a gear tooth and a release member positioned on an inner surface thereof. A plug assembly comprises a plug housing and a lever rotatably mounted on the plug housing, the lever having at least one gear tooth cooperable with the header gear tooth, such that rotation of the lever causes engagement of the header gear tooth and the plug housing gear tooth, drawing the plug member into the cavity. A cam portion is cooperable with the post for moving the plug housing upon counter rotation of the lever locking member.

In yet another embodiment, a connector assembly, comprises a header having a cavity defined by at least one wall, the wall having a gear tooth positioned on an inner surface thereof and a contact surface positioned within the header. A plug assembly comprises a plug housing and a lever rotatably mounted on the plug housing, the lever having at least two gear teeth cooperable with the header gear tooth, and a cam portion cooperable with the contacts surface, whereby when the lever is rotated in a first rotative sense, a first gear tooth of the at least two gear teeth contacts the header gear tooth to draw the plug assembly into the header, and rotation of the lever in an opposite rotative sense causes the cam to contact the contact surface to lift the plug housing, and to position a second gear tooth of the at least two gear teeth in contact with the header gear tooth, whereby continued rotation lifts the plug assembly out of the header.

An embodiment of the invention will now be described with reference to the following drawings.

DETAILED DESCRIPTION OF EMBODIMENTS OF THE INVENTION

Figure 1:
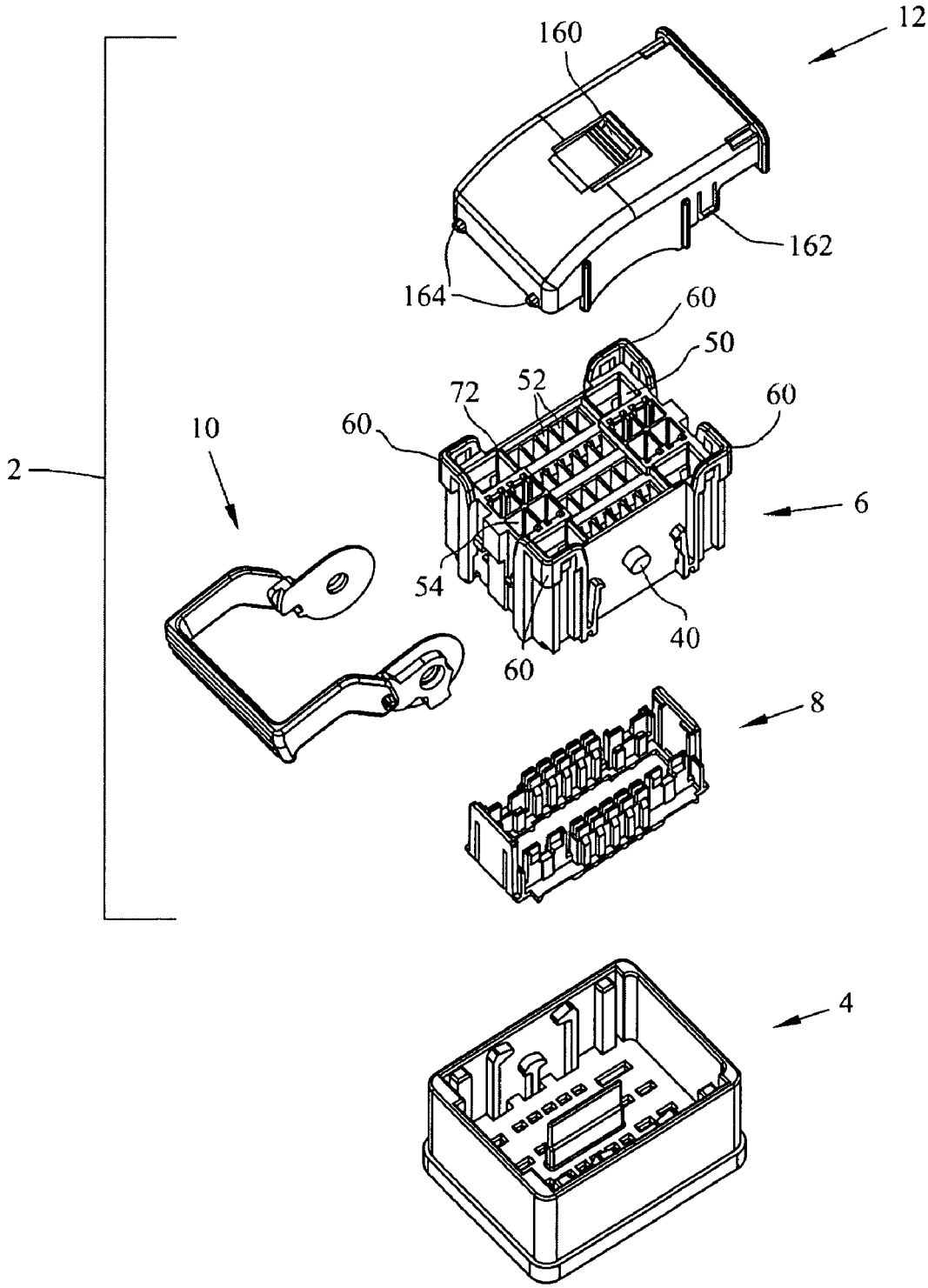
FIG. 1 is an exploded view showing the major components of a plug and header assembly.

Referring first to FIG. 1, a plug assembly 2 is shown in an exploded manner poised for receipt within a header 4. The plug assembly 2 is comprised of a plug housing 6, a terminal position assurance member (TPA) 8, a lever 10 and a wire shroud 12. With the components generally described, the individual components will be described in greater detail.

Figure 3:
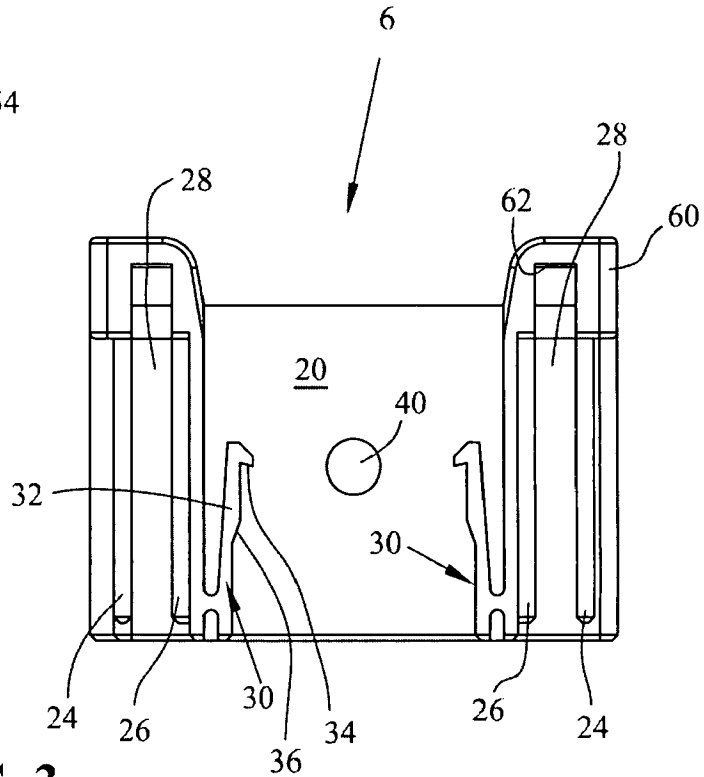
FIG. 3 shows a side plan view of the plug housing of FIG. 2.
Figure 2:
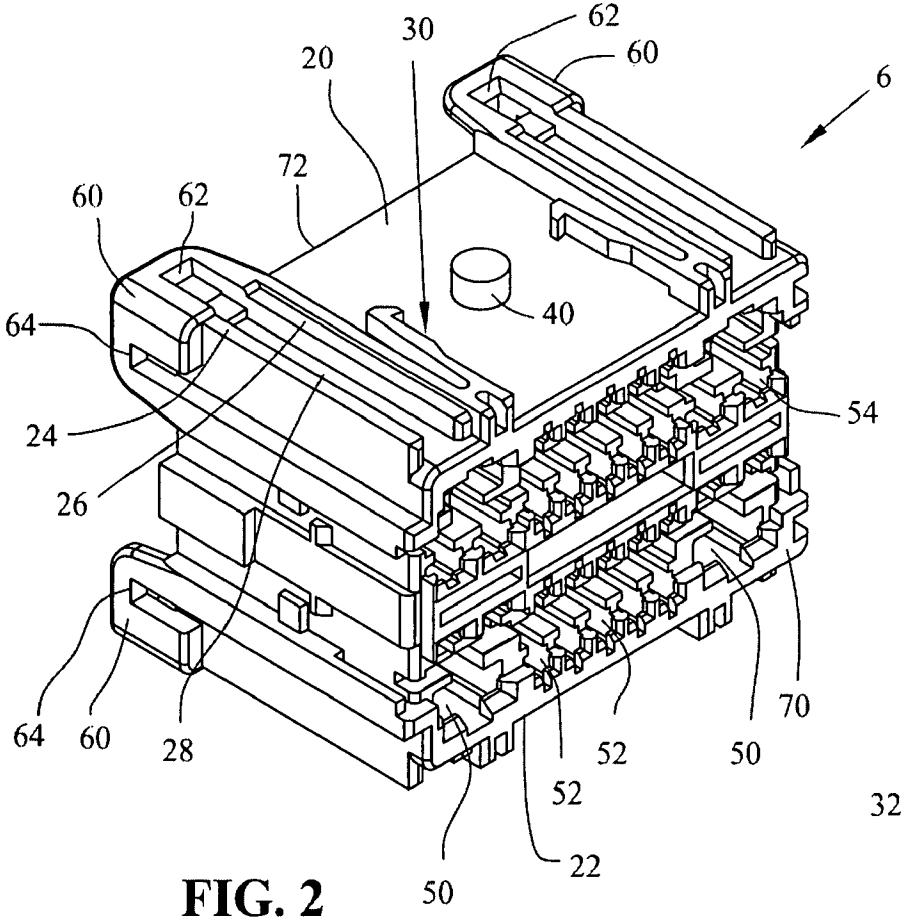
FIG. 2 shows a perspective view of the plug housing.

With reference now to FIG. 2, the plug housing 6 is comprised of sidewalls 20 and 22 where each sidewall includes a pair of ribs 24, 26, defining a channel 28 therebetween. As shown best in FIG. 3, a locking member 30 is positioned inwards of ribs 26 and is defined by a cantilevered arm 32 having a locking pawl 34. Cantilevered arm 32 further includes a cam surface 36 as will be described further herein. Sidewalls 20 each include a pivot mount 40 in the form of a cylindrical pin. As shown in FIGS. 1 and 2, plug housing 6 includes terminal receiving cavities such as 50, 52, and 54. Cavities 50, 52, and 54 would extend generally between a mating face 70 and a terminal receiving face 72. As also shown in FIGS. 1-3, plug housing 6 includes corner posts 60 each defining latching surfaces 62 and 64.

Figure 4:
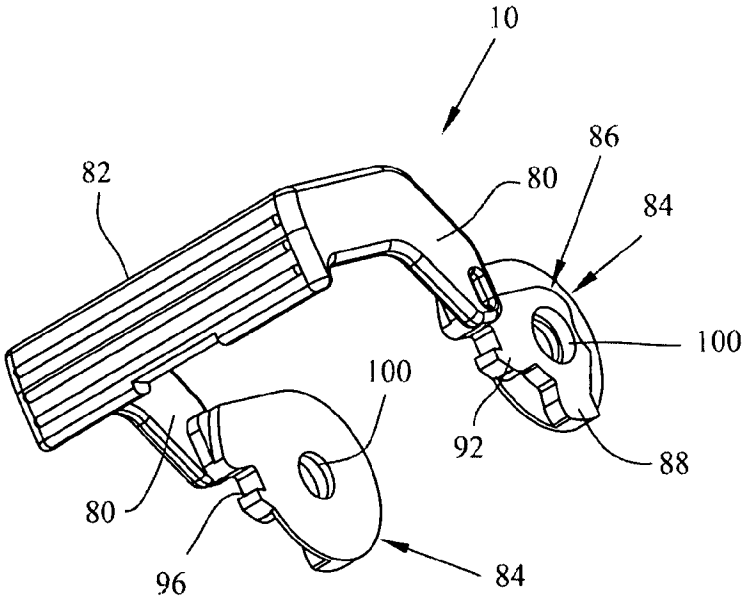
FIG. 4 shows a front perspective view of the lever of FIG. 1.
Figure 5:
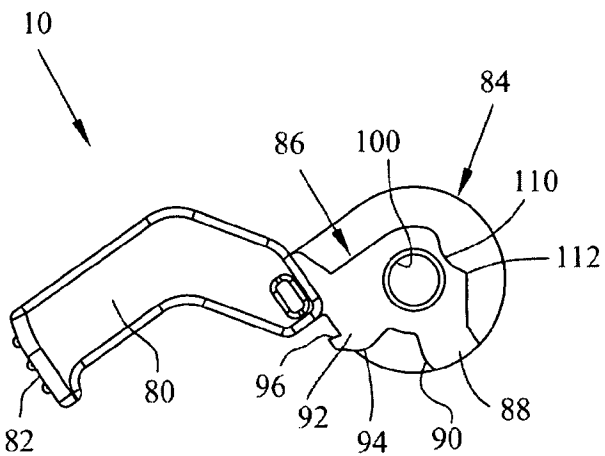
FIG. 5 shows a side plan view of the lever of FIG. 4.

With reference now to FIGS. 4 and 5, lever 10 will be described. Lever 10 generally comprises two lever arms 80 connected by way of a handle 82 where each lever arm 80 is connected to a central hub 84. Central hub 84 is comprised of a raised portion 86 which includes a first gear tooth 88 having a surface 90 (FIG. 5), a second gear tooth 92 having a surface 94 (FIG. 5) and a locking surface at 96. A central bore 100 extends entirely through the central hub 84 and is profiled to be received over pin 40. As also shown in FIG. 5, raised portion 86 includes a detent surface 110 having a lifting member in the form of a cam portion 112 on one side thereof.

Figure 6:
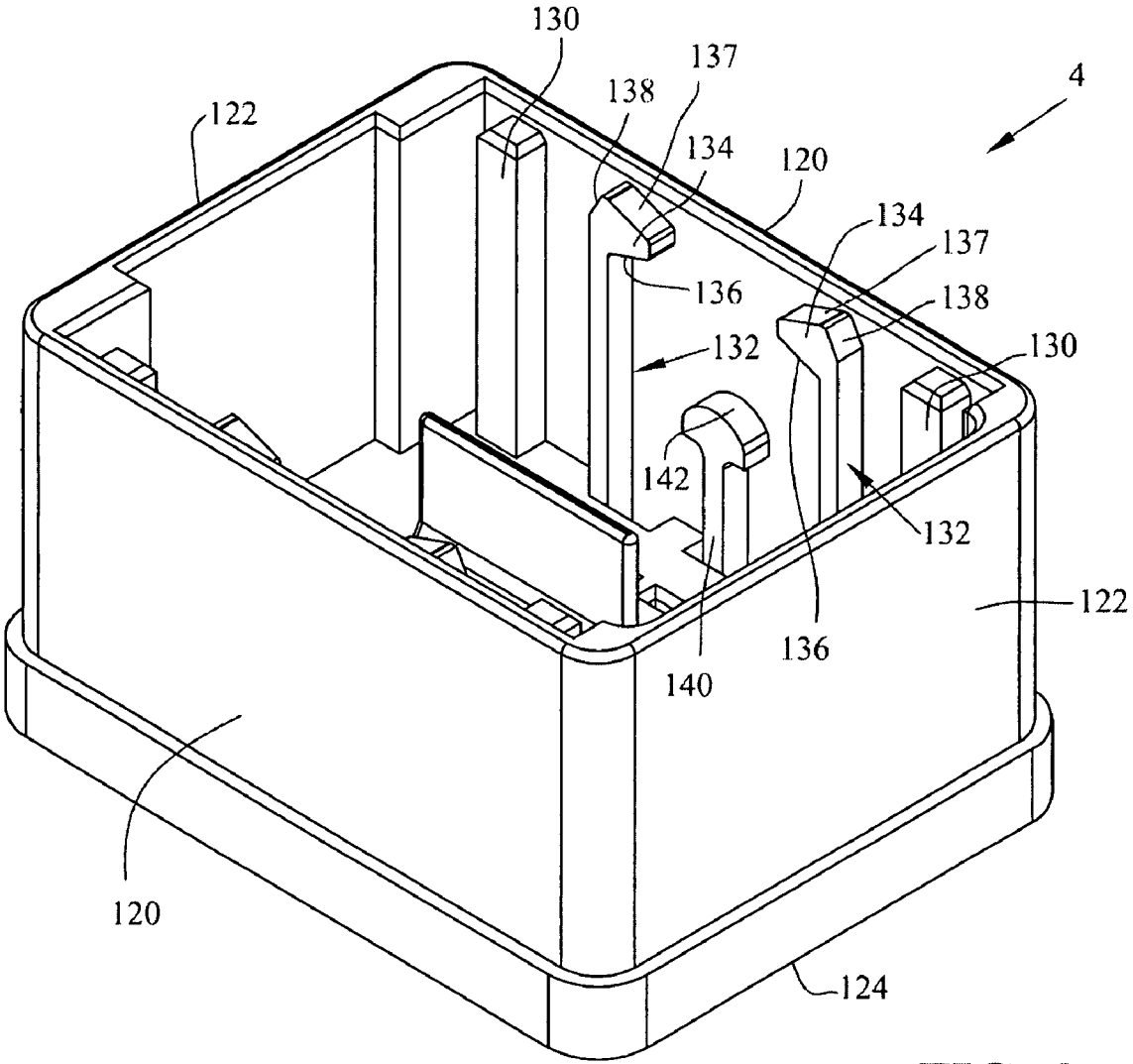
FIG. 6 shows a top perspective view of the header housing.
Figure 7:
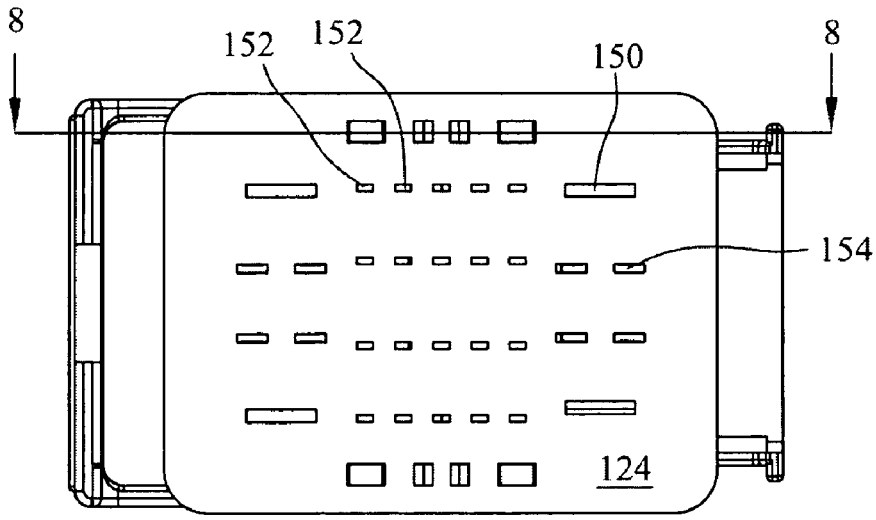
FIG. 7 shows a bottom plan view of the plug assembly positioned within the header assembly.

With respect now to FIG. 6, header 4 will be described in greater detail. Header 4 is comprised of sidewalls 120, end walls 122 and lower base wall 124. The sidewalls define an inner cavity. While Applicants show a rectangular configuration, a single wall of cylindrical configuration could also be used. Each sidewall 120 includes on an inner side thereof polarizing posts 130, drive posts 132 and center posts 140. Each of the drive posts 132 is comprised of a gear tooth 134 having a lower surface 136 and upper surface 137 and a release member defined by release surface 138. Center post 140 includes an upper arcuate surface at 142. Finally as shown in FIG. 7, lower base wall 124 includes large through holes 150 in alignment with terminal passageways 50, apertures 152 in alignment with terminal passageways 52 and apertures 154 in alignment with terminal receiving passageways 54. Apertures 150, 152, and 154 would include pins and/or tabs for interconnection with socket terminals positioned in the apertures 50, 52 and 54 as is well known in the art.

It should be appreciated to those skilled in the art that assembly of the plug assembly 2 as shown in FIG. 1 would include the termination of multiple insulated conductors to multiple socket contacts, and then loading the contacts into the various apertures 50-52. The conductors would be dressed to one side of the housing, and to the right as viewed in FIG. 1. The wire shroud 12 would be snap-latched to the various corner posts 60 of the plug housing 6, by positioning lugs 164 (FIG. 1) against latching surface 64, and latches 162 in and against latching surfaces 62. The TPA 8 will then be snap-loaded into the mating end of plug housing 6 to insure the correct positioning of the various socket terminals. It should also be appreciated that lever 10 is also positionable over pin 40 such that the lever is moveable between positions where the plug assembly 2 may be inserted into header 4, to where the plug assembly 2 is fully locked within the header 4.

Figure 8:
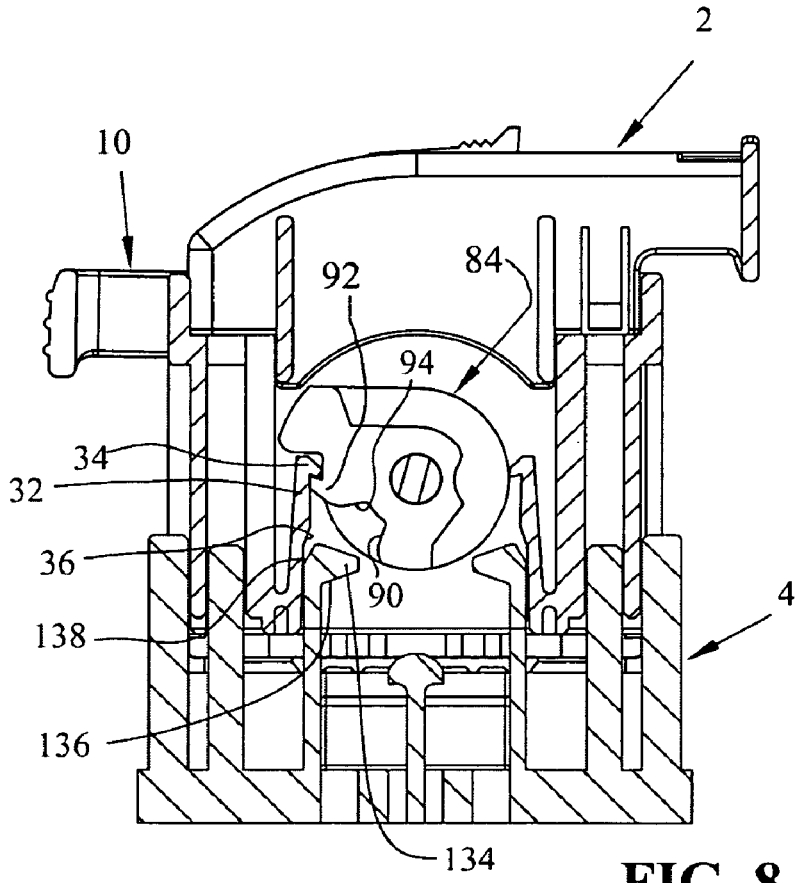
FIG. 8 shows a cross-sectional view through lines 8-8 of FIG. 7.
Figure 9:
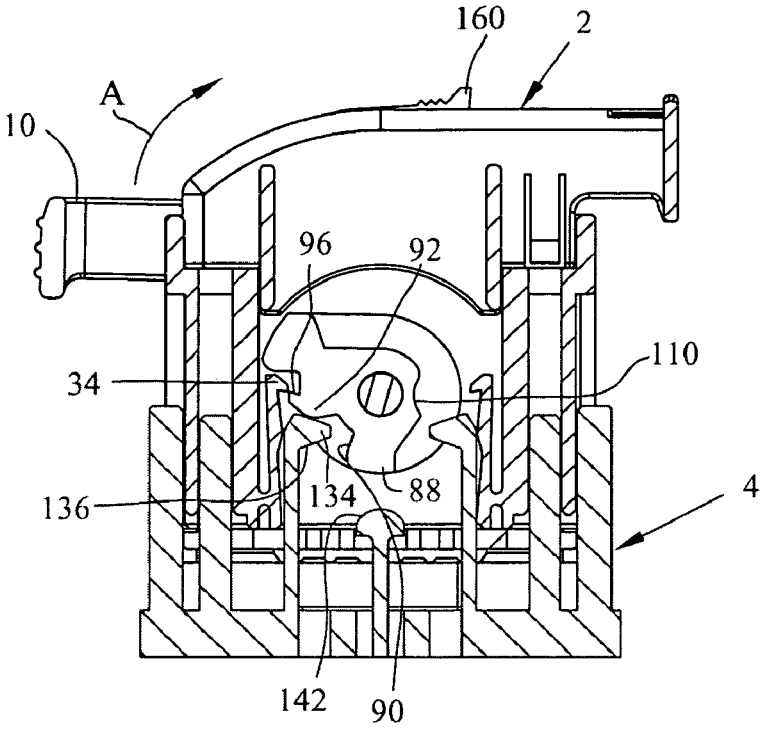
FIG. 9 shows a view similar to that of FIG. 8 where the plug assembly is positioned within the header to the point where the lever lock is tripped.
Figure 10:
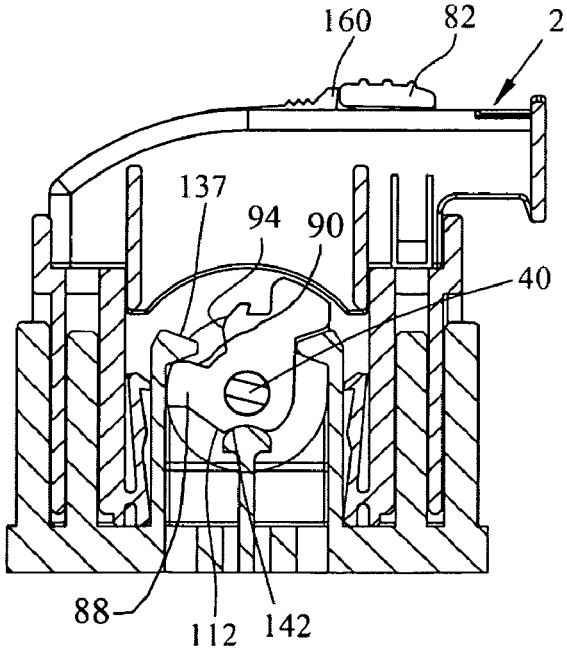
FIG. 10 shows a fully mated condition of the plug assembly and header.

In the embodiment shown, and with particular reference to FIG. 8, lever 10 is shown in the plug assembly insertion position where locking pawl 34 locks against locking surface 96 (FIG. 4) of the central hub 84, and the lever 10 is locked in place in the fully open position. In this position, the first and second gear teeth 88, 92 are in an optimum position such that a receiving area is defined between the tooth surfaces 90 and 94 to receive gear tooth 134 therebetween. In the FIG. 8 position, as plug assembly 2 is presented to the header 4, cam surface 36 approaches release surface 138 such that the cantilever arm 32 deflects open to the position shown in FIG. 9 thereby releasing locking pawl 34 from locking surface 96. In this position, gear tooth 134 is positioned between first and second gear teeth 88 and 92 and clockwise rotation of lever 10 is allowed. Rotation of lever 10, in the direction of arrow A in FIG. 9, will cause tooth surface 90 to engage tooth surface 136. Continued rotation of lever 10 will pull plug housing 2 into header 4, to the position shown in FIG. 10, where detent surface 110 abuts arcuate surface 142. In this position, handle 82 locks in a latch 160 defined in wire shroud 12, as shown in FIG. 10. This constitutes the fully mated position of the plug assembly 2 and the header 4.

Figure 11:
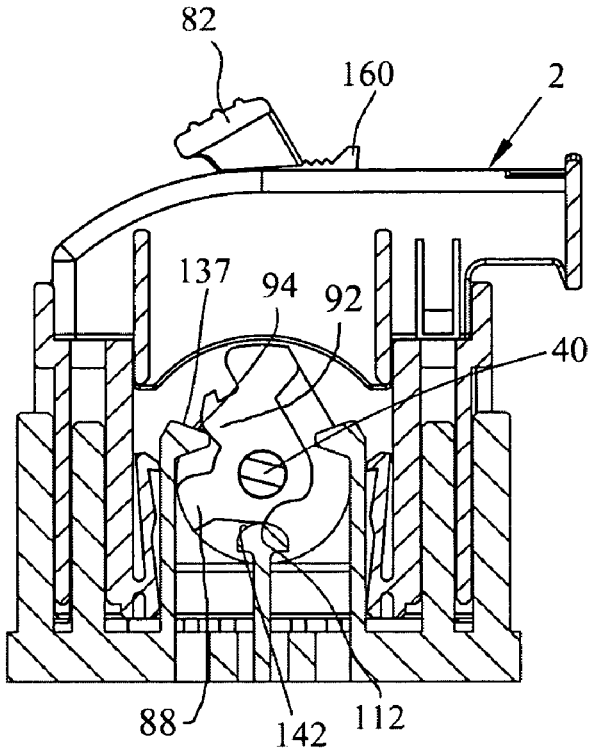
FIG. 11 shows the lever counter-rotated to begin lifting the plug assembly out of the header.
Figure 12:
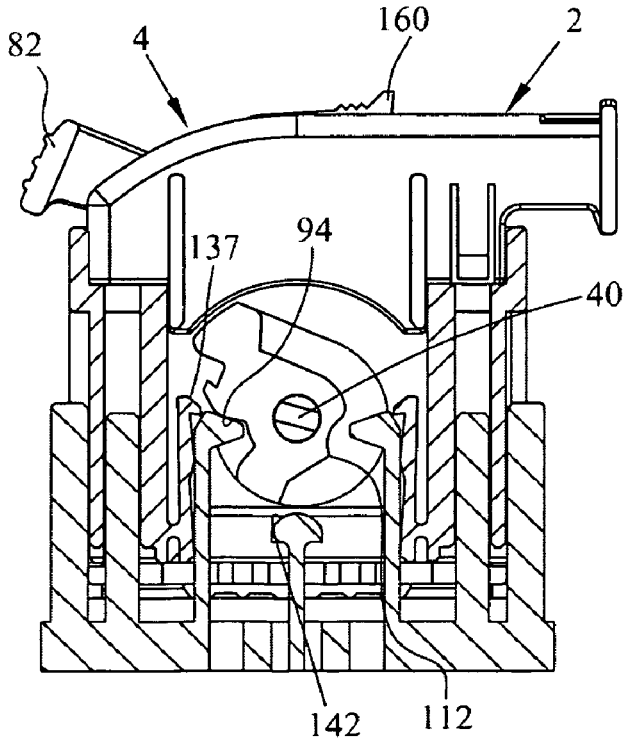
FIG. 12 shows a view similar to that of FIG. 11 with the lever further counter-rotated.

When the plug assembly 2 requires removal, latch 160 is depressed and the lever 10 is counter-rotated, in a counter-clockwise sense, as shown in FIG. 11, where cam portion 112 contacts the upper arcuate contact surface 142 of post 140. This causes a pre-lifting of the plug assembly, and also takes up the angular clearance between gear tooth surface 94 and upper surface 137, which presents a more optimum contact angle for interaction between surfaces 94 and 137. This also prevents any binding between the plug assembly 2 and the header 4. Continued counter-rotation of lever 2, as shown in FIG. 12, causes contact between the gear tooth surface 94 and contact surface 137 (FIG. 11) which pulls the plug assembly out of the header, back to a position similar to that shown in FIG. 9, where the plug assembly 2 may be pulled out of the header 4.

Figure 13:
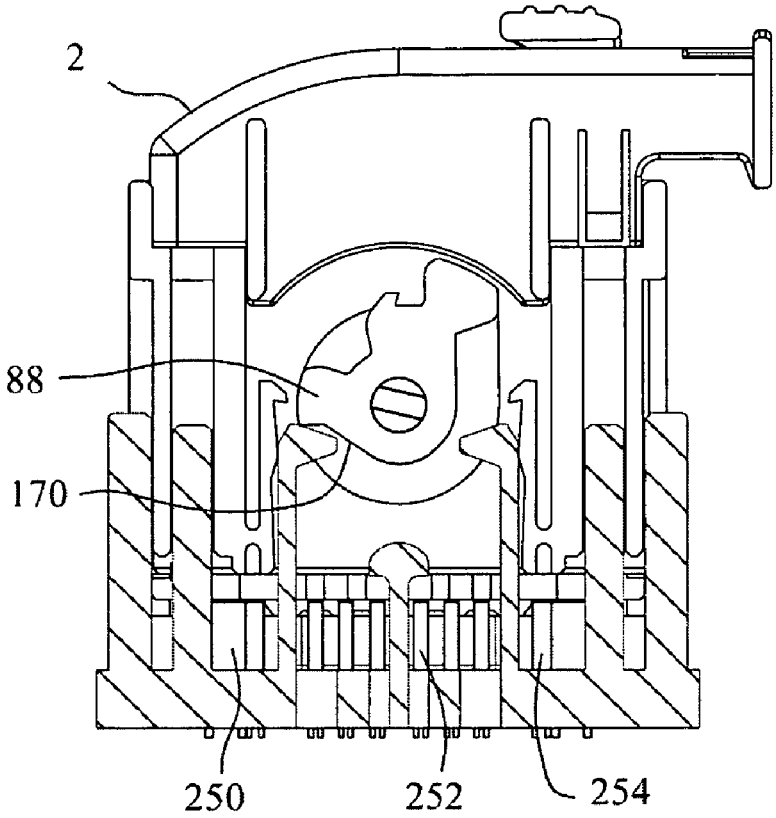
FIG. 13 shows a view similar to that of FIG. 8, where the connector is inadvertently inserted incorrectly.

The plug assembly 2 is also designed such that incorrect insertion does not damage the assembly. With reference now to FIG. 13, in the event that the lever 10 is in the wrong position when plug assembly 2 is inserted in header 4, a surface 170 on the back side of tooth 88 contacts surface 137, thereby preventing contact between the plug housing 6 and the terminals 250, 252 and 254.

What is claimed is:

1. A connector assembly, comprising:

a header having a cavity defined by at least one wall, the wall having a gear tooth positioned on an inner surface thereof;

a plug assembly comprising a plug housing and a lever rotatably mounted on the plug housing, the lever having at least one gear tooth cooperable with the header gear tooth, such that rotation of the lever causes engagement of the header gear tooth and the plug housing gear tooth, drawing the plug member into the cavity;

a lifting member for lifting the plug assembly out of the header when the lever is counter-rotated; and the lever and the lifting member cooperate to define a detented and fully inserted position of the plug assembly.

2. The connector assembly of claim 1, wherein the lifting member is located on said lever.

3. The connector assembly of claim 2, wherein the lever is comprised of a central hub portion, with the at least one gear tooth arranged adjacent a peripheral edge thereof.

4. The connector assembly of claim 3, wherein said lifting member comprises a cam portion formed on said central hub portion.

5. The connector assembly of claim 4, wherein said header further comprises a post which cooperates with said cam portion.

6. The connector assembly of claim 5, wherein said post has an upper arcuate surface.

7. The connector assembly of claim 6, wherein said central hub portion is formed with a detent surface, which cooperates with said upper surface of said post to define the detented and fully inserted position.

8. The connector assembly of claim 7, wherein said cam portion is located adjacent to said detent surface, whereby rotation of said lever causes said cam portion to contact said post upper arcuate surface.

9. A connector assembly, comprising:

a header having a cavity defined by at least one wall, the wall having a gear tooth on an inner surface thereof and a post positioned within the header;

a plug assembly comprising a plug housing and a lever rotatably mounted on the plug housing at a position laterally aligned with the post, the lever having at least one gear tooth cooperable with the header gear tooth, such that rotation of the lever causes engagement of the header gear tooth and the plug housing gear tooth, drawing the plug member into the cavity; and a cam portion cooperable with the post for moving the plug housing upon counter rotation of the lever.

10. The connector assembly of claim 9, wherein the post is located on an inner surface of the header.

11. The connector assembly of claim 10, wherein the lever is comprised of a central hub portion, with the cam portion and the at least one gear tooth arranged adjacent a peripheral edge thereof.

12. The connector assembly of claim 11, wherein said post has an upper arcuate surface.

13. The connector assembly of claim 12, wherein said central hub portion is formed with a detent surface, which cooperates with the upper arcuate surface of said post to define a fully inserted position.

14. The connector assembly of claim 13, wherein said cam portion is located adjacent to said detent surface, whereby rotation of said lever causes said cam portion to contact said post upper arcuate surface.

15. The connector assembly of claim 9, wherein the lever has at least two gear teeth cooperable with the header gear tooth, such that rotation of the lever in a first rotative sense causes a first gear tooth to contact said header gear tooth to draw the plug assembly into the header, and rotation of the lever in an opposite rotative sense causes the cam to contact the post to lift the plug housing, and to position a second gear tooth in contact with said header gear tooth, whereby continued rotation lifts the plug assembly out of the header.

16. A connector assembly, comprising:

a header having a cavity defined by at least one wall, the wall having a gear tooth on an inner surface thereof and a post within the header having an upper arcuate contact surface positioned within the header;

a plug assembly comprising a plug housing and a lever rotatably mounted on the plug housing, the lever having at least two gear teeth cooperable with the header gear tooth, and a cam portion cooperable with the upper arcuate contact surface, the lever being comprised of a central hub portion, with the at least two gear teeth and cam portion arranged adjacent a peripheral edge thereof, whereby when the lever is rotated in a first rotative sense, a first gear tooth of the at least two gear teeth contacts said header gear tooth to draw the plug assembly into the header, and rotation of the lever in an opposite rotative sense causes the cam to contact the contact surface to lift the plug housing, and to position a second gear tooth of the at least two gear teeth in contact with said header gear tooth, whereby continued rotation lifts the plug assembly out of the header.

17. The connector assembly of claim 16, wherein said central hub portion is formed with a detent surface, which cooperates with said upper surface of said post to define a fully inserted position.

18. The connector assembly of claim 17, wherein said cam portion is located adjacent to said detent surface, whereby rotation of said lever causes said cam portion to contact said post upper arcuate surface.

* * * * *